United States Patent [19]

Johannsen

[11] 4,351,163

[45] Sep. 28, 1982

[54] AIR CONDUCTING MECHANISM

[76] Inventor: Donald L. Johannsen, 3742 W. Solar Dr., Phoenix, Ariz. 85021

[21] Appl. No.: 317,463

[22] Filed: Nov. 2, 1981

Related U.S. Application Data

[62] Division of Ser. No. 168,655, Jul. 11, 1980, abandoned.

[51] Int. Cl.[3] ..... F28D 5/00

[52] U.S. Cl. ..... 62/305; 62/314; 62/428; 62/171

[58] Field of Search ..... 62/304, 305, 309, 311, 62/314, 332, 428, 506, 507, 171

[56] References Cited

U.S. PATENT DOCUMENTS

| | | | |
|---|---|---|---|
| 3,182,718 | 5/1965 | Goettl | 62/311 |
| 3,229,610 | 1/1966 | Webster | 98/41 R |
| 3,859,818 | 1/1975 | Goettl | 62/309 |
| 4,066,118 | 1/1978 | Goettl | 62/325 |
| 4,175,403 | 11/1979 | Lunde | 62/305 |

*Primary Examiner*—Albert J. Makay
*Assistant Examiner*—Harry Tanner
*Attorney, Agent, or Firm*—Herbert E. Haynes, Jr.

[57] ABSTRACT

An air conducting mechanism for receiving evaporatively cooled air from a source thereof and delivering the evaporatively cooled air to the air inlet face of the condenser coil of a remotely located refrigeration unit.

5 Claims, 7 Drawing Figures

AIR CONDUCTING MECHANISM

CROSS-REFERENCE TO RELATED APPLICATION

This application is a divisional application of copending prior application Ser. No. 168,655, filed July 11, 1980 abandoned, for AIR CONDUCTING MECHANISM by the same inventor.

BACKGROUND OF THE INVENTION

B 1. Field of the Invention

This invention relates in general to air conditioning systems and more particularly to a mechanism which utilizes evaporatively cooled air for improving the operating efficiency of a refrigeration unit.

2. Description of the Prior Art

For many years residential and business establishments in warm, arid and semi-arid climates were cooled almost exclusively by evaporative cooling. As is well known, evaporative coolers are relatively low cost devices, both from initial cost and operating cost standpoints, and are very effective at times of relatively low humidity and become less effective as the humidity increases.

Due to the lessening of cooling effectiveness in times of relatively high humidity, many existing evaporative coolers were replaced with refrigeration units when such units were developed in suitable packages and at reasonable initial costs, and new construction went almost exclusively to the use of refrigeration units. This trend, away from evaporative coolers to refrigeration units, started about 20 to 25 years ago and was very well accepted by the consuming public as long as energy was plentiful and relatively inexpensive.

Now, however, with energy in relatively short supply and with the escalating energy costs, many are looking once again to the evaporative cooler for a source of economic relief. The trend today is not a complete reversal of the movement away from evaporative coolers, but is toward a compatible union of evaporative coolers and refrigeration units.

To establish a compatible union, most consumers are placing both an evaporative cooler and a refrigeration unit in communication with a common air delivery ducting network, and using the evaporative cooler when climatic conditions allow the effective use thereof and use the refrigeration unit only when necessary.

A typical installation of this type usually includes a riser duct leading from the air distribution ducting network to the refrigeration unit and a separate riser duct leading to the evaporative cooler, with each of those riser ducts having some sort of damper mechanism mounted therein. When the refrigeration unit is being used, the damper in its riser duct is, of course, open and the damper in the riser duct leading to the evaporative cooler is closed, and when the evaporative cooler is being used the damper positions are reversed.

This combined usage of evaporative coolers and refrigeration units is proving to be very successful and such combination systems are being installed in ever increasing numbers. However, it is believed that such systems could be more effectively used by adapting the system so that the relatively inexpensively operated evaporative cooler could be utilized to reduce the building heat load and to increase the operating efficiency of the refrigeration unit when it is being operated to cool the living space of the building.

It has long been known that the heat buildup in attic spaces above an area that is being cooled can have a considerable effect on the heat load of the cooled area. For example, in the attic space of a single story building located in a warm climate such as the Southwestern part of the United States, attic temperatures of 120° F. to 150° F. are not uncommon in the summertime. If the area being cooled is kept at about 80° F. this means that a temperature differential of from about 40° F. to 70° F. is felt across the ceiling. In the absence of insulation, the ceiling becomes in effect, a radiant heater shortly after the sun comes up and remains that way until well after sunset. Even with proper attic insulation, the flow of heat from the attic into the living area is not completely stopped but is merely reduced in intensity and slowed down in that the heat in the attic space will increase the temperature of the insulation during the daytime and when the sun goes down the heated insulation will radiate heat into the living area well into the nighttime hours. From this it will be seen that the heat buildup in attic spaces places a considerable heat load on the air conditioning unit being used to cool the living space. It has been estimated that in a typical single story building, about one third of the heat load comes from the ceiling.

Recently, a very effective means has been suggested for more efficient usage of the combined air conditioning systems of the above described type, and this means is fully disclosed in U.S. patent application Ser. No. 146,663 filed on May 5, 1980, for an "Air Diversion Duct" by Mark N. Worthington. Briefly, the air diversion duct of the above referenced U.S. patent application is a two-position device which is mounted in the riser duct leading from the evaporative cooler to the building's air distribution ducting network. When the combination air conditioning system is in its evaporative cooling mode, the air diversion duct is positioned to supply evaporatively cooled air directly to the air distribution ducting network in the customary manner. When the combination air conditioning system is in its refrigeration mode, the air diversion duct is placed in its second position which isolates the evaporative cooler from the building's air distribution ducting network and opens auxiliary air outlets which are in communication with the building's attic space. In this manner, the evaporative cooler may be operated to supply the evaporatively cooled air to the building's attic space and thereby help to reduce the overall heat load on the building.

The air diversion duct of the above referenced U.S. patent application adds considerable versatility and efficiency to the known combination air conditioning system. However, it is believed that the combination air conditioning system can be further enhanced by addition of a mechanism which increases the efficiency of the refrigeration unit while it is being operated to cool the living space of the building.

As is well known, the condenser coil of a refrigeration unit, either of the conventional type or a heat pump, must be cooled for proper operation of the refrigeration unit. Some refrigeration systems are liquid cooled but these are usually very large commercial units. The most commonly used system for radiating the heat of condensation into the atmosphere is accomplished by drawing atmospheric air across the condenser coil by means of a power operated fan, and then exhausting the air back into the atmosphere. Cooling of the condenser coil by air is relatively efficient as long as the temperature of the atmospheric air is low, i.e., does not exceed for example, 90° F. to 95° F. Unfortunately, when a refrigeration unit is needed most, atmospheric air temperatures are usually above the point at which condenser cooling is efficiently accomplished, and ambient temperatures within the refrigeration unit can be considerably above atmospheric air temperature. When the atmospheric air temperature is, for example, 110° F., the temperature within the unit itself, in which the condenser and compressor are housed, may be as high as 140° F. or even 150° F. depending on the location of the refrigeration unit. This relatively higher temperature of the ambient air is due to absorption of heat from the sun as well as the generation of heat due to the work being performed by the refrigeration unit.

As atmospheric and ambient temperatures increase, the condenser coil cooling efficiency drops and when this occurs, the head pressure against which the refrigeration unit compressor is operating increases. When the head pressure increases, the compressor operates longer and draws more amperage. This, of course, results in increased operating costs with decreased unit longevity.

This problem has long been recognized and attempts have been made over the years to find an efficient low cost way of keeping the temperature of the air used in cooling the condenser coil at a temperature at which such cooling is efficiently accomplished.

A particular prior art attempt to enhance the air cooling of the condenser coil of a refrigeration unit is disclosed in U.S. Pat. No. 3,108,451 issued on Oct. 29, 1963 to A. E. Clifford. In the Clifford structure, a porous pad of the type commonly used in evaporative coolers is positioned in the air path leading to the condenser coil. The pad is wetted with water so that the air moving toward the coil through the pad is cooled by evaporation. In this coil cooling arrangement, and the many variations thereof tried throughout the years, two problems have kept such mechanisms from achieving any significant degree of commercial success.

The first problem with these prior art coil cooling arrangements results from free moisture carried by the evaporatively cooled air. The free moisture is deposited on the condenser coil and on other components within the refrigeration unit, and such deposition causes scaling and corrosion which decreases the heat radiating capabilities of the condenser coil in particular and other unit components in general. In a surprisingly short time, the scaling and corrosion will ruin those components.

The second problem with this prior art coil cooling arrangement is restricted airflow to the condenser coil. The wetted pad will restrict airflow to the coil somewhat, but, this alone will not present any problem as long as the wet pad is clean. However, mineral deposition, or scaling, of the pad is an inherent problem along with trapped airborne matter such as dirt. Due to the nature of the pads, it is not practical to clean them, thus, periodic replacement is required. As is all too often the case, the time between pad replacements is often extended beyond what it should be and in some cases is ignored entirely. When this occurs, the prior art coil cooling arrangement compounds the problem rather than alleviating it.

To the best of my knowledge, no devices or mechanisms have been devised or suggested to provide a combination air conditioning system of the above described type with the capabilities of increasing the operating efficiency of its refrigeration unit.

SUMMARY OF THE INVENTION

In accordance with the present invention, a new and useful air conducting mechanism is disclosed for delivering evaporatively cooled air from a remote source to the condenser coil of a refrigeration unit to reduce the sensible heat of the ambient air which is used to cool that coil to a point where such cooling is efficiently accomplished.

The air conducting mechanism of the present invention is particularly well suited for operation in conjunction with a combination air conditioning system having the air diversion duct of the hereinbefore referenced U.S. patent application installed therein.

As is known, a combination air conditioning system is a selectively operable assembly having two operating modes, the general operation of which will now be described to facilitate understanding of the preferred use of the mechanism of the present invention.

In a first operating mode, the refrigeration unit is shut off and physically isolated from the rest of the system such as by a damper mounted in the riser duct leading from the air distribution ducting network to the refrigeration unit. The evaporative cooler is operated in this first operating mode to supply evaporatively cooled air to the ducting network and thus to the space being cooled. Evaporative coolers work on the principal of moving quite large volumes of air through the space being cooled and exhausting that air to ambient after it has moved through the spaced being cooled. Until recently, the exhausting of the evaporatively cooled air was accomplished by simply leaving a window or windows of the building partially open. For building security reasons, and for more efficient operation, it is now a common practice to provide barometric dampers in the ceiling of the areas being cooled so that the evaporatively cooled air will be exhausted to ambient through the attic space. This is a significant improvement in that the air exhausted in this fashion will help reduce the heat buildup in the attic space and will thus reduce the heat load in the area being cooled.

Operation of the combination air conditioning system in the above described first operating mode is a very economical way to cool an area and is quite effective as long as the humidity is relatively low.

When the humidity increases to a point where the evaporative cooler is no longer effective, the combination air conditioning system is switched to its second operating mode. The evaporative cooler is shut off and physically isolated from the rest of the system by means of a damper located in its riser duct and the refrigeration unit is operated to provide cool air to the space being cooled. Refrigeration units operate by recirculatingly moving considerably less volumes of air in comparison with an evaporative cooler. Thus, the barometric dampers in the ceiling remain closed and the system does not provide any air to the attic space.

Refrigeration units are well known to be considerably more expensive to operate in comparison with evaporative coolers, and yet, the more expensive unit must work harder to overcome a higher heat load than the evaporative cooler in that in the second operating mode, the combination air conditioning system was heretofore incapable of doing anything to reduce the heat buildup in the attic space above the area being cooled.

The air diversion duct of the hereinbefore referenced U.S. patent application enhances the operation of the well known and above described combination air conditioning system by providing it with the capability of reducing attic temperature buildup during the operation of the refrigeration unit. The air diversion duct which provides this additional operational capability is mounted in the riser duct leading from the air distribution ducting network to the evaporative cooler, and it is provided with a normal airflow path which directs air from the cooler to the ducting network when the system is in the first operating mode. The air diversion duct is also provided with a pair of auxiliary air outlet ports through which evaporatively cooled air may be supplied directly into an attic space when the combination air conditioning system is in the second operating mode. The air diversion duct is provided with a damper by which the air is selectively directed either to the distribution ducting network or to the attic space.

A combination air conditioning system provided with such an air diversion duct may be operated in what may be described as a third operational mode. In this third mode the refrigeration unit is being operated to cool the living area of a building, and the evaporative cooler is being operated to reduce the heat buildup in the attic space above the living area.

The air conducting mechanism of the present invention further enhances the operation of a combination air conditioning system by providing it with the capability of directing some of the evaporatively cooled air to the condenser coil of the refrigeration unit when the system is operating in its third operational mode.

The air conditioning mechanism includes suitable ducting, one end of which is connected to one of the auxiliary air outlet ports of the air diversion duct so that part of the evaporatively cooled air is supplied directly to the air conducting mechanism. The other end of the ducting is connected to an air distribution manifold which is mounted adjacent the condenser coil of the refrigeration unit so that the evaporatively cooled air is directed across the air inlet face of the condenser coil and is thereby mixed with the ambient air being drawn through the coil for cooling purposes. In this manner, the sensible heat of the air which is used to cool the refrigeration unit's condenser coil is reduced to a point at which condenser coil cooling is efficiently accomplished.

Since refrigeration units are intermittently operated devices, the air conducting mechanism of the present invention is provided with a damper means which allows delivery of evaporatively cooled air to the air delivery manifold when the refrigeration unit is operating, and vents that air into the building's attic space when the refrigeration unit is not operating.

Although the air conducting mechanism of the present invention is preferably operated in conjunction with the above described operationally enhanced combination air conditioning system, it is not intended that the mechanism be limited only to such use in that it may be operated in conjunction with any source of evaporatively cooled air.

Accordingly, it is an object of the present invention to provide a new and improved air conducting mechanism for improving the operating efficiency of an air conditioning system.

Another object of the present invention is to provide a new and improved air conducting mechanism for improving the operating efficiency of a refrigeration unit.

Another object of the present invention is to provide a new and improved air conducting mechanism which improves the operating efficiency of a refrigeration unit by supplying evaporatively cooled air from a remote source to reduce the sensible heat of the ambient air which is being used to cool the condenser coil of the refrigeration unit.

Another object of the present invention is to provide a new and improved air conducting mechanism of the above described character wherein the evaporatively cooled air is distributed across the air inlet face of the refrigeration unit's condenser coil by an air distribution manifold located adjacent the coil.

Another object of the present invention is to provide a new and improved air conducting mechanism of the above described character which includes a damper means for supplying the evaporatively cooled air to the refrigeration unit only when the unit is operating.

Still another object of the present invention is to provide a new and improved air conducting mechanism of the above described character which includes a damper means for supplying the evaporatively cooled air to the refrigeration unit when the unit is operating, and supplying the evaporatively cooled air to another point of use when the refrigeration unit is not operating.

Yet another object of the present invention is to provide a new and improved air conducting mechanism of the above described character wherein the evaporatively cooled air is supplied to the mechanism from the evaporative cooler of a combination air conditioning system when the evaporative cooler is being operated to cool the attic space of a building while the refrigeration unit of the system is being operated to cool the living space of the building.

The foregoing and other ojbects of the present invention, as well as the invention itself, may be more fully understood from the following description when read in conjunction with the accompanying drawings.

DESCRIPTION OF THE PREFERRED EMBODIMENTS

Figure 1:
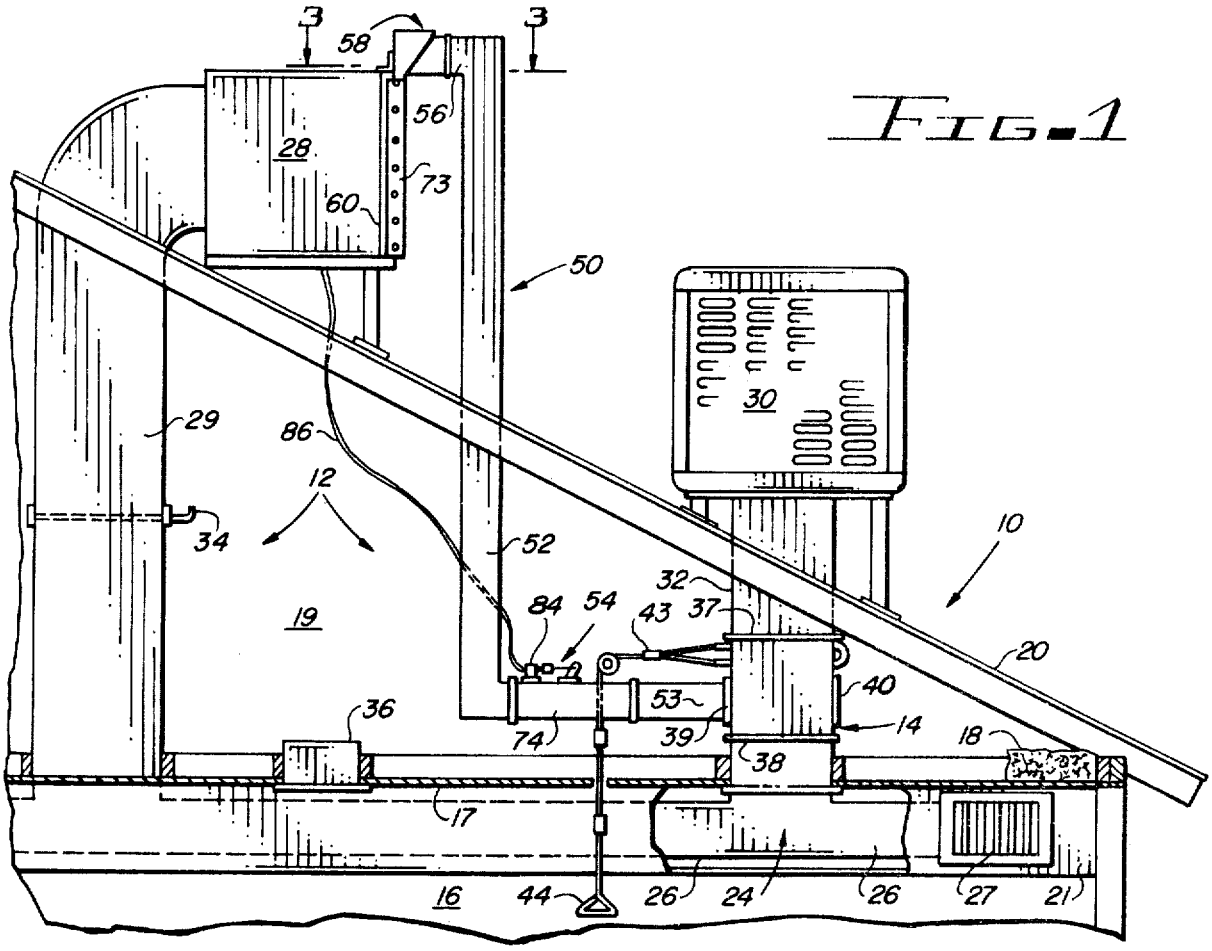
FIG. 1 is a diagrammatic sectional view of a typical building having a combination air conditioning system installed therein to illustrate the preferred operational environment and to show the preferred condifuration of the air conducting mechanism of the present invention.

Referring more particularly to the drawings, FIG. 1 diagrammatically illustrates a building 10 in which a combination air conditioning system 12 is installed, with the system having the air diversion duct of the hereinbefore referenced U.S. patent application installed therein, with the air diversion duct being indicated generally by the reference numeral 14.

The building 10 is illustrative of a typical structure and is not intended to be construed as a limitation of the present invention. The building 10 includes a living area 16 having a ceiling 17 on which the usual insulative material 18 is supported to thermally insulate the attic space 19 from the living area, with the attic space being covered by the usual roof 20. Although the structural details of the building 10 may differ, it is shown for descriptive purposes as including a dropped ceiling portion 21 which is a standard method for routing the air delivery ducting network 24 to the desired locations within the building 10.

The air delivery ducting network 24, which is part of the combination air conditioning system 12, as is well known in the art, includes a plurality of branch ducts 26 which extend to various parts of the building, and each branch duct terminates in at least one air register 27 which delivers air to the living area 16. Conditioned air is supplied to the distribution ducting network as will hereinafter be described, either from a refrigeration unit 28 which is connected to the network 24 by a riser duct 29, or from an evaporative cooler 30 which is connected to the distribution ducting network by a riser duct 32 which is especially configured to contain the air diversion duct 14.

To insure a clear understanding of the purpose and operation of the air conditioning system 12, a brief operational description thereof will now be made with reference to FIG. 1.

In the first operating mode of the combination air conditioning system 12, the refrigeration unit 28 is shut off and isolated from the rest of the system such as by insertion of a flat plate damper 34 in the riser duct 29. The evaporative cooler is operated to deliver evaporatively cooled air through its riser duct 32, with the air diversion duct 14 being properly positioned as will hereinafter be described, to the air distribution ducting network 24 into the living area 16 via the registers. The evaporatively cooled air may be exhausted from the living area 16 to ambient in any convenient manner. However, for maximum system efficiency, it is preferred that this air exhausting function be accomplished by special dampers 36 (one shown) which are installed at various locations in the ceiling 17 of the building 10. These dampers are normally closed barometric damper devices which will open in response to the increased air pressure provided by the evaporative cooler and thus will exhaust the evaporatively cooled air from the living area 16 through the attic space 19. This will reduce the attic temperature buildup and thus reduce the heat load in the living area.

When the humidity becomes too high for effective cooling of the living area by the evaporative cooler 30, the combination air conditioning system 12 may be switched to a second operating mode. In the second mode, the evaporative cooler 30 is shut off and isolated from the rest of the system 12, by use of the air diversion duct 14 as will hereinafter be described, and the refrigeration unit 28 is connected to the distribution ducting network such as by removing the damper 34 from its riser duct 29. In this manner, refrigerated air is supplied to the living area 16 via the branch ducts 26 and air registers 27. Since the air pressure provided by the refrigeration unit 28 is considerably less than that provided by the evaporative cooler 30, the barometric dampers 36 will remain in their normally closed positions, and the refrigeration unit 28 will operate on the recirculating air principal as is common in such units.

The air diversion duct 14 provides the combination air conditioning system 12 with another, or third operational mode, and the operation of the air diversion duct 14 will now be briefly described to facilitate understanding of this third operating mode.

Figure 2:
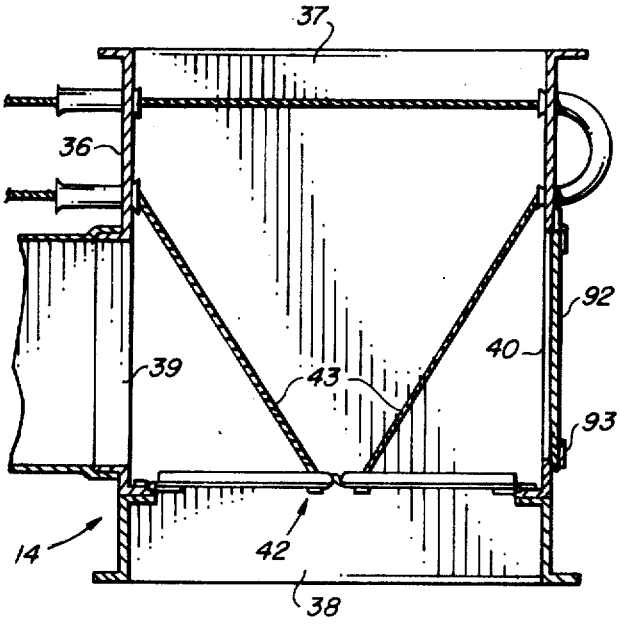
FIG. 2 is an enlarged sectional view of the air diversion duct which forms part of the combination air conditioning system in which the air conducting mechanism of the present invention is preferably installed.

As seen in FIG. 2, the air diversion duct 14 includes a housing 36 having an air inlet 37, an air outlet 38 with a pair of auxiliary air outlet ports 39 and 40 extending laterally and oppositely from the housing. A damper means 42 is mounted in the housing 36 and is operable by means of a cable arrangement 43 for movement between two positions. The cable arrangement 43 is provided with a suitable handle 44 (FIG. 1) which is located in the living space 16 of the building 10. When the damper means 42 is in the position shown, the air path between the air inlet 37 and the air outlet 38 is closed so that evaporatively cooled air entering into the housing 36 will exit therefrom through the auxiliary air outlet ports 39 and 40. When the damper means 42 is moved to the second position, the air movement path between the air inlet 37 and the air outlet 38 will be open and the auxiliary air outlet ports 39 and 40 will be closed by means of the individual damper plates of the damper means 42. In this second position, the evaporatively cooled air will pass through the air diversion duct 14 thus allowing the combination air conditioning system 12 to operate in its above described first operational mode, and when the air diversion duct 14 is in its second position the combination air conditioning system 12 will operate in its second operational mode. The above mentioned third operational mode of the combination air conditioning system 12 is accomplished by placing the air diversion duct 14 in its first operating position, as shown in FIG. 2, and operating the evaporative cooler 30 so that it supplies cool air to the attic space 19 while the refrigeration unit 28 is cooling the living area 16.

The air conducting mechanism of the present invention, which is indicated generally by the reference numeral 50, is preferably used in conjunction with the above described combination air conditioning system 12. As seen in FIG. 1, the air conducting mechanism 50 includes a duct 52 of suitable configuration having an air inlet 53 which is connected to the auxiliary air outlet port 39 of the air diversion duct 14 so that when the combination air conditioning system is operating in its third mode, part of the evaporatively cooled air, which would otherwise be vented into the attic space 19, is supplied to the air conducting mechanism 50. The duct 52 of the air conducting mechanism 50 is provided with a damper means 54 therein, as will hereinafter be described, and its opposite end 56, or air outlet, is connected to an air distribution manifold 58.

As is known, the refrigeration unit 28 includes a condenser coil 60 which must be cooled for proper operation of the unit. Such cooling is accomplished by an air moving device (not shown) which is usually in the form of a fan and is mounted within the refrigeration unit so as to draw atmospheric air through the condenser 60 and then expel that air back into the atmosphere.

The air distribution manifold 58 of the air conducting mechanism 50 is suitably mounted on the cabinet of the refrigeration unit 28 so as to be adjacent the air inlet face of the condenser coil 60. The air distribution manifold 58 functions to deliver the evaporatively cooled air so that it reduces the sensible temperature of the atmospheric air to a point where it will effectively cool the condenser.

Figure 3:
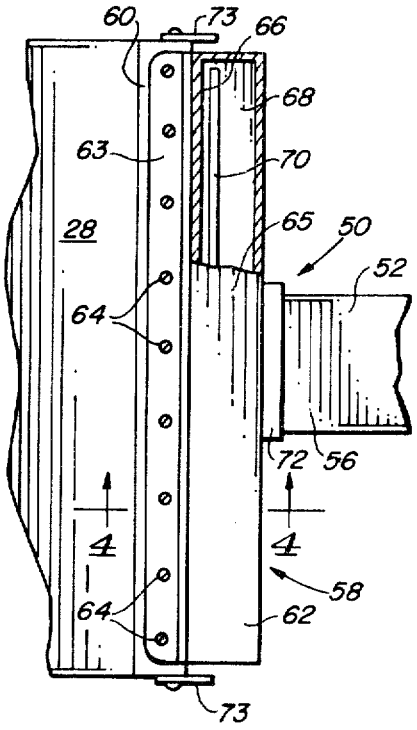
FIG. 3 is an enlarged fragmentary plan view taken along the line 3—3 of FIG. 1 and is partially broken away to show the various features of the air distribution manifold device of the air conducting mechanism of the present invention.
Figure 4:
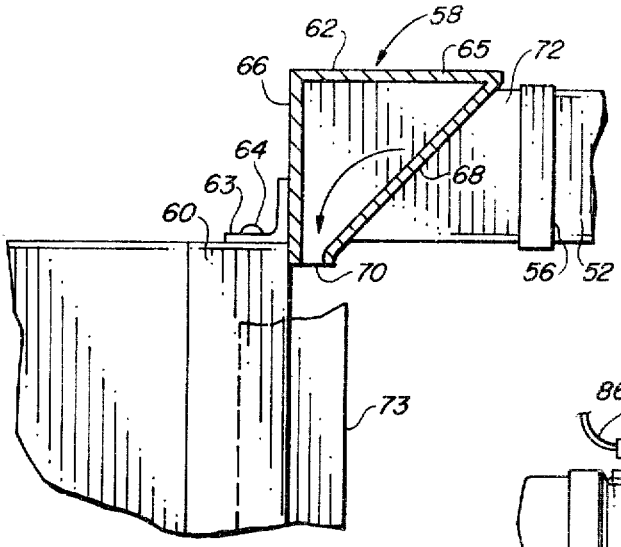
FIG. 4 is a fragmentary sectional view taken along the line 4—4 of FIG. 3.

As seen best in FIGS. 3 and 4, the air distribution manifold 58 is in the form of an elongated housing 62 having a mounting flange 63 by which it is attached to the refrigeration unit with suitable fasteners 64. The housing 62 is closed at its opposite ends and is provided with an elongated top wall 65, from one longitudinal edge of which a back wall 66 integrally depends. An integral front wall 68 slopes angularly and downardly from the other longitudinal edge of the top wall 65 so that its lower edge is adjacent the lower edge of the back wall 66 and is spaced therefrom to provide an elongated slot 70 therebetween. The sloping wall 68 is provided with an inlet duct 72 to which the end 56 of the duct 52 is connected. In this way, the evaporatively cooled air is supplied to the air distribution manifold 58 and will emerge therefrom at an increased velocity due to the outlet slot 70 being relatively smaller than the internal chamber of the manifold housing 62.

It is preferred that the manifold 58 be mounted above the condenser coil 60 of the refrigeration unit 28 in the manner shown due to the natural tendency of cold air to fall. However, the manifold may be mounted on any of the other edges of the coil 60 in that the air emerging therefrom is under pressure. In any event, the air emerging from the manifold's outlet slot 70 is directed across the air inlet face of the condenser coil 60 in a sheet-like manner and will mix with the atmospheric air being drawn through the coil and thus reduce the sensible temperature thereof.

A pair of elongated planar baffles 73 may be mounted on the opposite sides of the condenser coil 60 in the manner shown, for controlling airflow and to prevent crosswinds from disrupting the normal airflow of the evaporatively cooled air, or otherwise disrupt its mixing with the inflow of atmospheric air.

Figure 5:
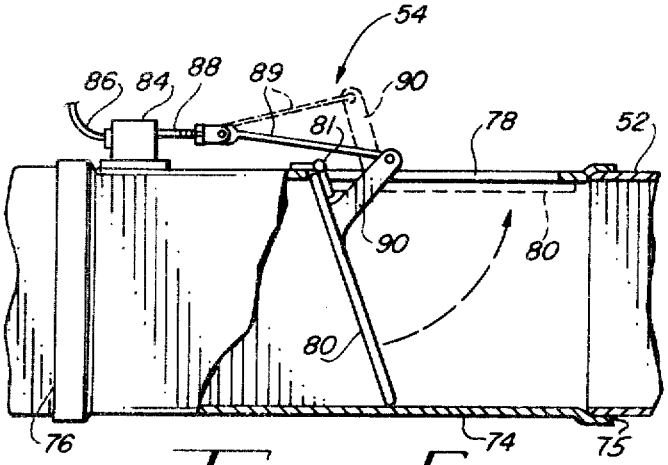
FIG. 5 is an enlarged side elevational view of the damper means of the air conducting mechanism of the present invention which is partially broken away to illustrate the various features thereof.

Since a refrigeration unit is by design an intermittently operated mechanism, the evaporatively cooled air emerging from the air distribution manifold 58 during times when the refrigeration unit 28 is not operating, would be wasted in the absence of the damper means 54. As shown in FIG. 5, the damper means 54 includes a duct segment 74, or housing, which is mounted in any convenient location in the duct 52 and is configured with an air inlet 75, an air outlet 76, with a vent port 78 formed in one of the sidewalls thereof. A damper plate 80 is hingedly mounted as at 81 so as to be movable from a first, or normal, position as shown, in which the air path leading to the air distribution manifold 58 is closed, to a second position wherein that air path is open. When the damper plate 78 is in the normal position, evaporatively cooled air will be vented through the vent port 78 into the attic space 19. When the damper plate 80 is moved to its second position to open the air path to the manifold 58, such movement of the damper plate will move it to the dashed line position shown in FIG. 5 thus closing the vent port.

The damper means 54 may be moved between its two positions in any convenient manner, which can, and preferably is, tied into the operation of the refrigeration unit. Since it is desirable to supply evaporatively cooled air to the air distribution manifold 58 when the refrigeration unit is operating, and to divert the air elsewhere when the refrigeration unit is not operating, the damper means 58 should be capable of sensing the operation of the refrigeration unit and positioning itself accordingly.

Therefore, a solenoid 84, or functional equivalent thereof, is mounted on the duct segment 74 and is coupled by means of suitable wires 86 into the electric circuitry (not shown) of the refrigeration unit 28. One way of connecting the wires 86 to the refrigeration unit would be to connect them into the circuit which supplies power to operate the air moving device (not shown) by which air is drawn through the condenser coil 60. In this way, when the air moving device is switched on, it will also energize the solenoid 84. The solenoid 84 has its plunger rod 88 in the extended position whenever it is in its normal, or de-energized state, and the rod 88 will be retracted upon energization of the solenoid. The solenoid plunger rod is connected by means of a connecting rod 89 to a lever 90 carried on the damper plate 80. In this manner, when the solenoid 84 is de-energized, refrigeration unit off, the damper plate 80 is positioned to vent the evaporatively cooled air into the attic space 19. When the solenoid 54 is energized, during operation of the refrigeration unit 28, the damper plate 80 closes the vent port and opens the airflow path to the air distribution manifold 58.

As seen in FIG. 2, the air diversion duct 14 has a hingedly mounted plate 92 over the auxiliary air outlet port 40 thereof. That plate is a barometric damper which will move in response to air pressure within the duct to open the port 40, and the necessary air pressure is supplied by the evaporative cooler 30. The barometric damper plate 92 is weighted as at 93 so that it will be normally closed and will open upon the exertion of a predetermined pressure thereon. The pressure required to open the damper plate 92 is determined by the amount of weight, and that amount is set so that the pressure required to open the damper plate 92 will be approximately equal to the head pressure which is inherent in the air conducting mechanism 50 of the present invention. This pressure balancing is desirable to insure that an adequate amount of air is delivered to the air conducting mechanism 50.

Figure 6:
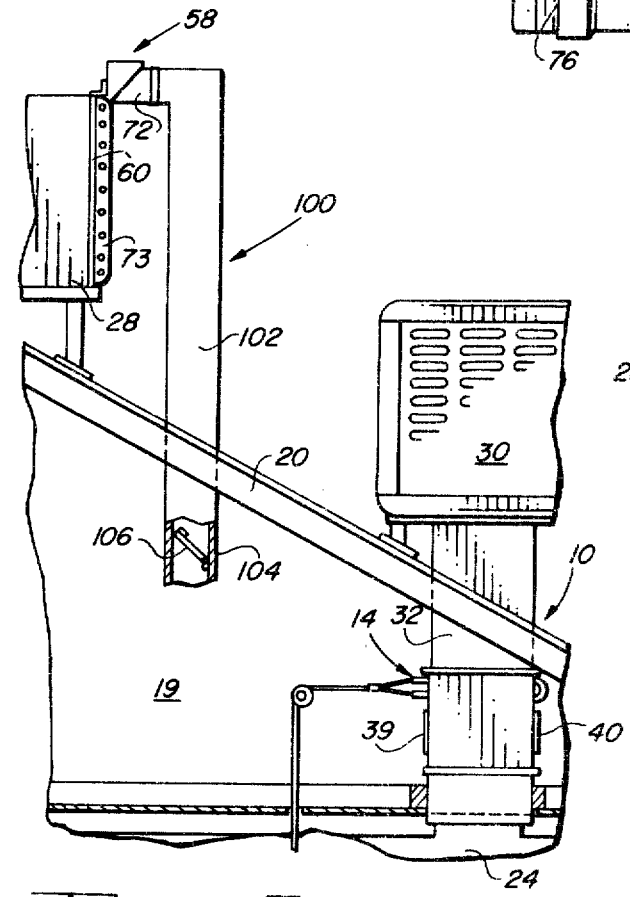
FIG. 6 is a diagrammatic illustration similar to FIG. 1 and showing a modification of the air conducting mechanism and illustrating another way that it can be used in conjunction with the combined air conditioning system.

Reference is now made to FIG. 6 wherein a modification of the air conducting mechanism of the present invention is shown, and is identified in its entirety by the reference numeral 100.

In this embodiment, the evaporative cooler 30 delivers air to the air distribution ducting network 24 or to the attic space 19 as determined by system operation and positioning of the air diversion duct 14. As is known, air delivered by an evaporative cooler will cause a pressure buildup in an enclosed area such as in the attic space 19, and such pressure buildup is relied upon to supply the evaporatively cooled air to the modified air conducting mechanism 100.

The air conducting mechanism 100 includes the hereinbefore described air distribution manifold 58 which is coupled to receive the air through the duct 102. One end of the duct 102 is connected to the inlet duct 72 of the manifold 58, and its other end 104 extends through the roof 20 of the building 10 and opens into the attic space 19. A barometric damper 106 is mounted in the duct 102 and is normally closed. The damper 106 will open upon a pressure buildup in the attic space thereby supplying air to the air distribution manifold 58.

Figure 7:
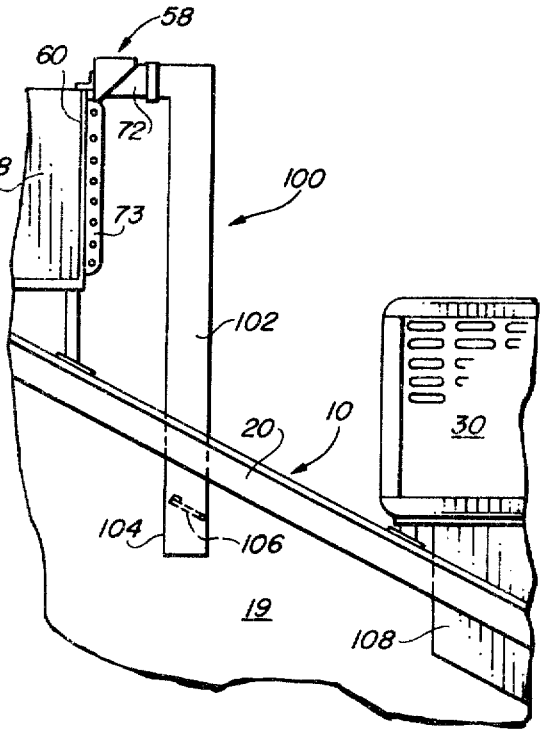
FIG. 7 is a view similar to FIG. 6 and showing the modified air conducting mechanism of that Figure as being used in conjunction with a remotely located source of evaporatively cooled air.

The same configuration of the air conducting mechanism 100 is shown in FIG. 7 as being used in conjunction with the evaporative cooler 30, the outlet 108 of which is adapted to supply evaporatively cooled air directly to the attic space 19 only. From this, it will be seen that the air conducting mechanism of the present invention can be used with any suitable remotely located source of evaporatively cooled air.

While the principles of the invention have now been made clear in illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. An air conditioning system comprising in combination:

(a) a refrigeration unit having an air outlet and a condenser coil;

(b) an evaporative cooler having an air outlet;

(c) means connecting the air outlet of said refrigeration unit to a first point of use;

(d) an air diversion duct connecting the air outlet of said evaporative cooler to the first point of use and to a second point of use, said air diversion duct including damper means having a first position for directing evaporatively cooled air to the first point of use and a second position for directing that air to a second point of use; and (e) an air conducting mechanism connected between said refrigeration unit and said air diversion duct for delivering evaporatively cooled air to the condenser coil of said refrigeration unit when the damper means of said air diversion duct is in its second position, said air conducting mechanism including, I. a duct having an air inlet connected to said air diversion duct for receiving evaporatively cooled air when the damper means of said air diversion duct is in its second position, said duct having an air outlet, II. an air distribution manifold connected to the air outlet of said duct for receiving the evaporatively cooled air therefrom, said air distribution manifold mounted adjacent the condenser coil of said refrigeration unit for distributing the evaporatively cooled air across the air inlet face of the condenser coil, III. damper means in said duct and connected to be responsive to the operation of said refrigeration unit for delivering the evaporatively cooled air to said refrigeration unit when it is operating and venting the evaporatively cooled air to the second point of use when said refrigeration unit is inoperative.

2. An air conditioning system as claimed in claim 1 wherein said air distribution manifold comprises an elongated housing having an air inlet connected to the air outlet of said duct and having an air outlet in the form of an elongated slot for distributing the evaporatively cooled air in a sheet-like pattern across the air inlet face of the condenser coil.

3. An air conditioning system as claimed in claim 2 wherein said air distribution manifold is mounted above the condenser coil of said refrigeration unit so as to extend along the top edge thereof, said air distribution manifold positioned so that the elongated air outlet slot thereof faces downwardly toward the air inlet face of the condenser coil.

4. An air conditioning system as claimed in claim 1 and further comprising baffle means mounted on opposite sides of the condenser coil of said refrigeration unit for controlling the flow of evaporatively cooled air from said air distribution manifold.

5. An air conditioning system as claimed in claim 1 wherein said damper means comprises:

(a) a duct section having an air inlet, an air outlet and a vent port;

(b) a damper plate mounted in said duct section and movable to a first position which closes the airflow path between the air inlet and the air outlet of said duct section and opens the vent port thereof, and a second position which opens the airflow path between the air inlet and the air outlet of said duct section and closes the vent port thereof; and (c) means connected for sensing the operation of said refrigeration unit and connected to said damper plate for moving said damper plate to its first position when said refrigeration unit is not operating and moving said damper plate to its second position when said refrigeration unit is operating.

* * * * *